US005169061A

United States Patent [19]

Buescher

[11] Patent Number: 5,169,061

[45] Date of Patent: Dec. 8, 1992

[54] TWO WAY ENVELOPE

[75] Inventor: Eugene J. Buescher, Lake St. Louis, Mo.

[73] Assignee: William R. O'Meara, Florissant, Mo. ; a part interest

[21] Appl. No.: 693,917

[22] Filed: Apr. 29, 1991

[51] Int. Cl.[5] ..... B65D 27/06
[52] U.S. Cl. ..... 229/305
[58] Field of Search ..... 229/73, 305

[56] References Cited

U.S. PATENT DOCUMENTS

| | | | |
|---|---|---|---|
| 2,527,925 | 10/1950 | Frampton | 229/73 |
| 3,062,431 | 11/1962 | Rabenold | 229/73 |
| 3,411,699 | 11/1968 | Pine et al. | 229/73 |
| 3,952,942 | 4/1976 | O'Leary et al. | 229/73 |
| 4,190,162 | 2/1980 | Buescher | 229/73 |
| 4,334,618 | 6/1982 | Buescher | 229/73 |
| 4,403,696 | 9/1983 | Newell | 229/73 |
| 4,445,635 | 5/1984 | Barr | 229/73 |
| 4,461,661 | 7/1984 | Fabel | 229/73 |
| 4,524,903 | 6/1985 | Vath | 229/73 |
| 4,602,736 | 7/1986 | Barr | 229/73 |
| 4,815,654 | 3/1989 | Buescher | 229/73 |
| 4,915,287 | 4/1990 | Volk et al. | 229/70 |

OTHER PUBLICATIONS

Copy of Two-Way Envelope, on sale prior to 1989 ("Giles").
Copy of Two-Way Envelope, on sale prior to 1989 ("The Blade").
Copy of Two-Way Envelope, on sale prior to 1989 ("First Steuben").
Copy of Two-Way Envelope, on sale prior to 1989 (National Auditing).
Two-Way Envelope (copy), on sale prior to 1989 ("Zykan").
Two-Way Envelope (copy), on sale prior to 1989 ("Western Union").

*Primary Examiner*—Stephen P. Garbe

[57] ABSTRACT

A two-way envelope includes front and back panels having a portion removable to open the two-way envelope with the other portion forming a reply envelope having an end closure flap for closing the reply envelope. The two-way envelope is preprinted with a reply address, a bar code corresponding to the reply address and an identification code indicating the presence of the bar code. After the two-way envelope is opened and the replay envelope closed, the reply envelope includes the reply address, bar code and identification code but not the outgoing address of the two-way envelope.

2 Claims, 8 Drawing Sheets

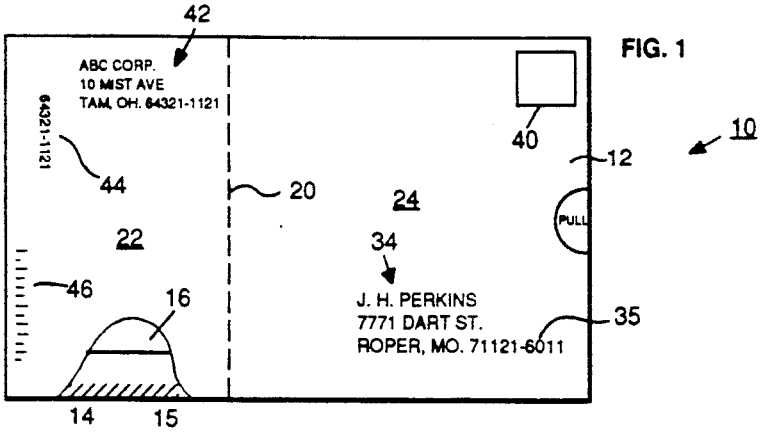
FIG. 1
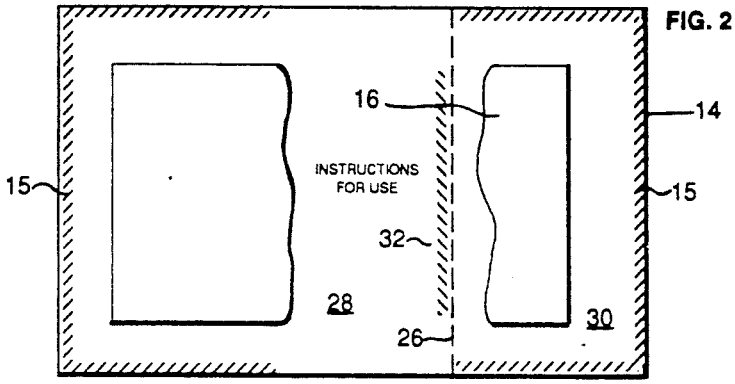
FIG. 2
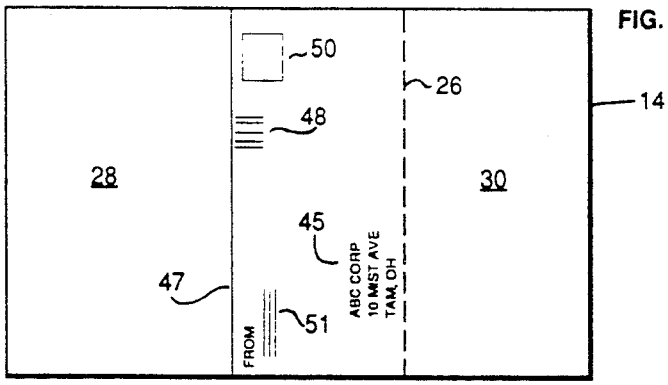
FIG. 3
FIG. 4
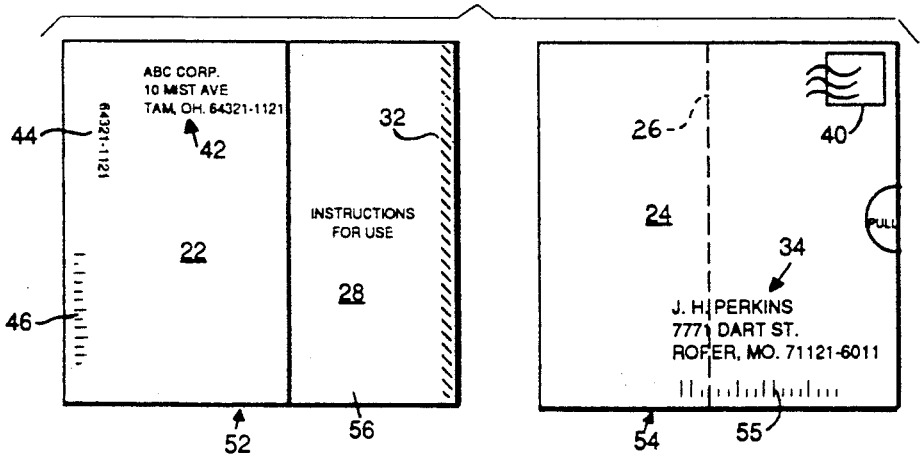

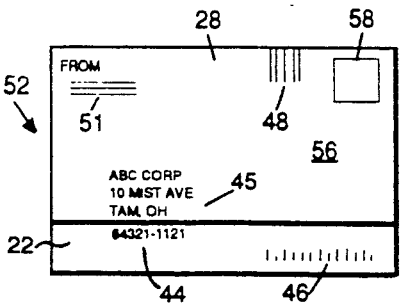
FIG. 5
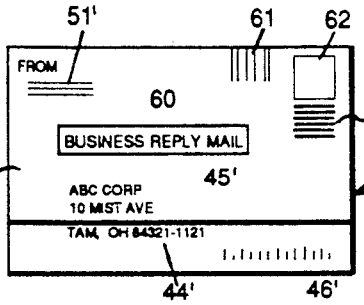
FIG. 7
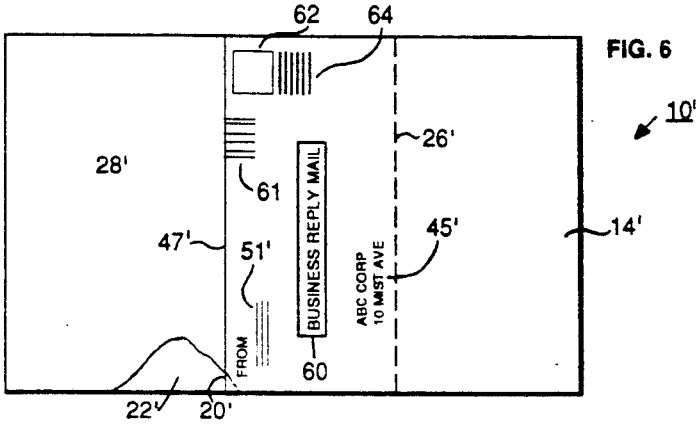
FIG. 6
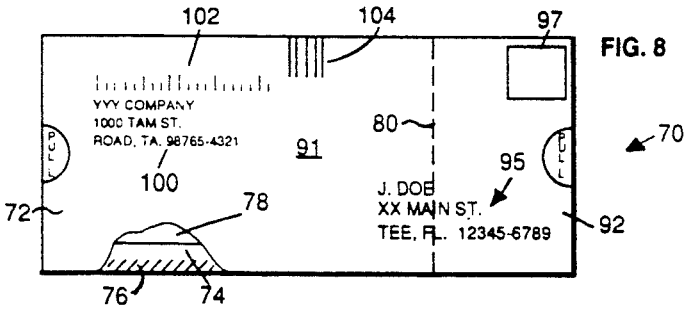
FIG. 8
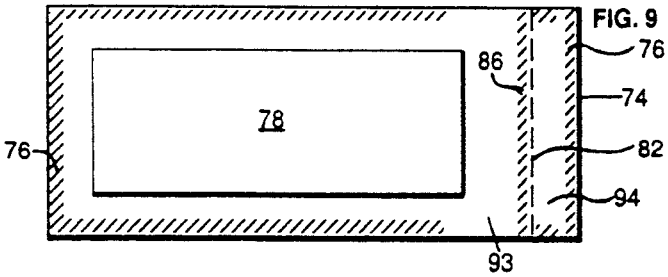
FIG. 9
FIG. 10
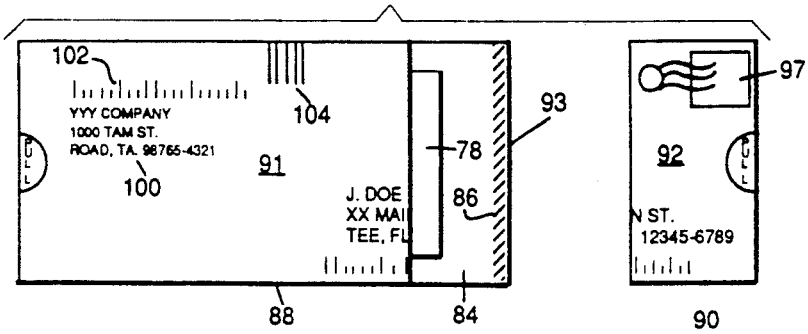

TWO WAY ENVELOPE

FIELD OF THE INVENTION

This invention relates to two-way envelopes and more particularly to a two-way envelope having a reusable portion for automatic processing through the postal service.

BACKGROUND

As is well known, the postal service employs automated mail processing systems to facilitate the handling, sorting and delivery of various types of mailers including envelopes and postcards. These automated systems employ codes and electronic code reading devices to effect more efficient and accurate mailing processing, improved consistency of delivery, lower postal operating costs and savings to postal customers.

Numerical mail processing codes corresponding to the address destinations and known as ZIP (Zone Improvement Program) codes are commonly used on envelopes. ZIP coded envelopes without other codes are sent through a postal station where the numerical ZIP codes are electronically scanned by an optical character reader (OCR) and a processing or sorting code, presently a bar code in the form of a series or pattern of vertical short and tall bars and which corresponds to the individual numerical code, is applied to each envelope. The bar coded envelopes are passed through a bar code reader (BCR) which electronically reads the bar codes and bar code sorters (BCS) to automatically sort the envelopes according to their bar codes or address destinations.

Reply envelopes that are mailed inside of originating or outgoing envelopes by senders such as business and other organizations are now often preprinted with bar codes. The bar code for reply envelopes for a given organization can be readily printed by the sender when the reply address and any other matter is printed on each of the reply envelopes since the reply address and bar code are the same for each such reply envelope. By preprinting the bar code on the reply envelopes they do not have to be passed through the OCR and encoder to be bar coded by the postal service and this can result in cost savings to both the sender and the postal service. Some organizations are preprinting bar codes on outgoing envelopes so that even further savings can be realized under certain circumstances with prebarcoded mail.

When the sender preprints the bar code on the reply envelope another processing or identification code, presently known as a facing identification mark or code (FIM), is also preprinted to provide machine detectable codes for the automatic facing and cancellation of reply mail as well as to identify prebarcoded reply mail early in the postal processing system. Different FIM marks or codes are presently used for identifying "courtesy reply" and "business reply" envelopes having preprinted bar codes. Such FIM codes are presently in the form of a series of parallel vertical lines printed by the sender in a location spaced from the bar code area.

The use of outgoing envelopes containing reply envelopes are, however, relatively expensive since two separate and complete envelopes are required and both envelopes must be separately printed with addresses.

SUMMARY OF THE INVENTION

It is an object of the present invention to provide an economical two-way envelope having a reusable portion thereof that forms a reply envelope after the two-way envelope is opened and wherein the reply envelope portion includes the necessary preprinted processing codes enabling its use in automated postal service mail processing systems utilizing processing codes.

Another object is to provide a two-way envelope of the above type which requires a minimum amount of paper and which results in reduced waste material after use, reduced tree cutting for paper stock, reduced mailing weight and bulk compared to the conventional use of two envelopes.

Another object is to provide an economical two-way envelope in which a portion thereof forms a reply envelope after the two-way envelope is opened and, wherein, the two-way envelope requires only two panels and is constructed and preprinted such that the reply envelope portion after the two-way envelope is opened includes a reply address, a facing identification code and a bar code and wherein the two-way envelope is not subject to being mismailed because of the reply address and other indicia.

Another object is to provide a two-way envelope of the above type, wherein, it is constructed and printed before mailing such that the reply envelope formed after the two-way envelope is opened is a business reply envelope requiring no additional postage.

Still another object is to provide an economical two-way envelope in which a portion thereof forms a reply envelope after the two-way envelope is opened and, wherein, the two-way envelope is constructed and printed with an outgoing address and bar code therefore, and a return address with a facing identification code and a bar code for the reply envelope such that the two-way envelope and the reply envelope individually are suitable for use in automated postal service mail processing systems utilizing processing codes.

In accordance with one aspect of the present invention, a two-way envelope is provided which includes front and back panels connected together to form a pocket for an element to be mailed. The front panel includes a removable portion for opening the two-way envelope and another portion which forms, with at least a portion of the back panel, a reply envelope having a closure flap. The two-way envelope includes reply address means for mailing the reply envelope, and preprinted sorting code means corresponding to the reply address means for mailing the reply envelope.

These, as well as other objects and advantages of the present invention, will become apparent from the following description and accompanying drawings.

BRIEF DESCRIPTION OF THE DRAWINGS

FIG. 1 is a front plan view of the front side of a two-way envelope in accordance with one embodiment of the present invention;

FIG. 2 is a plan view of the inner side of the back panel of the envelope of FIG. 1 along with an element to be mailed;

FIG. 3 is a plan view of the outer side of the back panel of the envelope of FIG. 1;

FIG. 4 is a plan view of the envelope of FIG. 1 after it has been opened;

FIG. 5 is a plan view of the reply envelope portion of FIG. 4 after it is closed;

FIG. 6 is a plan view of the outer side of a back panel of a two-way envelope in accordance with another embodiment of the present invention;

FIG. 7 shows a closed business reply envelope formed from the two-way envelope of FIG. 6;

FIG. 8 is a plan view of the front side of a two-way envelope made in accordance with another embodiment of the present invention;

FIG. 9 is a plan view of the inner side of the back panel and of an insert of the envelope of FIG. 8;

FIG. 10 is a plan view of the envelope of FIG. 8 after it has been opened;

DESCRIPTION OF THE PREFERRED EMBODIMENTS

Figure 11:
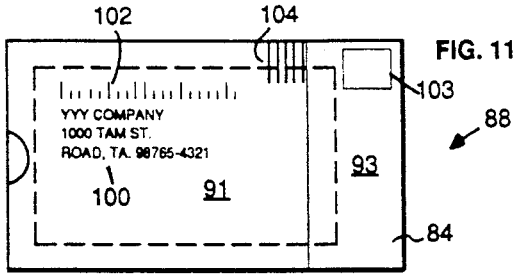
FIG. 11 is a plan view of the reply envelope portion of FIG 10 after it has been closed.

Referring now to the drawings and especially to FIGS. 1-5, there is shown in FIG. 1 a two-way or reusable envelope 10 made in accordance with the present invention.

Envelope 10 includes front and back panels 12 and 14, respectively, connected together by an adhesive 15 and shown with an insert between the panels, such as a sheet 16, having, for example, information thereon. The envelope 10 is shown closed, addressed and ready for mailing. The front panel 12 has a tear line of weakness 20 shown as a vertical, breakable line of perforations extending between the upper and lower edges of panel 12 dividing it into a left hand portion 22 and a right hand portion 24. Back panel 14, as seen in FIG. 2, also has a vertical tear line of perforations 26 extending vertically between the upper and lower edges of panel 14 dividing it into a left hand portion 28 and a right hand portion 30.

As seen in FIG. 2 adhesive 15 extends around the panel 14 at the margins thereof except in the marginal areas between the lines of perforations 20 and 26, as will be explained hereafter. A vertically extending line of dry adhesive 32 is shown at the right end of back panel portion 28 adjacent the line of perforations 26.

The front side of portion 24 of panel 12 is shown printed with an outgoing address, indicated generally at 34, and which includes a numerical address code or ZIP code 35. The ZIP code 35 is shown as a nine digit code but could be a five digit code or a code having any number of digits. Postage 40 is also shown in the upper right hand corner of the envelope. Postage 40 may be in any suitable form such as a postage stamp, meter imprinting, a government free indication, or in any other suitable form. A horizontally extending return address 42 is shown on the left panel portion 22 near its upper edge. Also, a portion 44 of a reply address which includes a ZIP or numerical address code, and a corresponding sorting or bar code 46, are shown pre-printed on panel portion 22 extending normal or vertically with respect to the horizontally or longitudinally extending outgoing address 34. The reply address portion 44 and bar code 46 are readable when the envelope is rotated 90 degrees about an axis normal to the plane of envelope 10 from its shown orientation in FIG. 1.

As seen in FIG. 3, the back or outer side of panel portion 28 of back panel 14 is shown having pre-printed thereon the other portion, indicated at 45, of the reply address. In this embodiment reply address portion 45 includes the name, street address, city, and state of the intended recipient of the reply envelope. Reply address portion 45 extends vertically relative to the horizontal or longitudinal axis of panel 14 and is located just to the left and parallel with the line of perforations 26 and is closer to the bottom edge of the envelope than to the upper edge. Also shown in FIG. 3 is a vertical crease or fold line 47, spaced leftwardly of perforation line 26 and extending between the top and bottom edges of panel 14 and which is substantially coincident with line of perforations 20 on front panel 12. A FIM or facing identification mark or code 48 are disposed to the right of fold line 47 and extends in a horizontal direction as viewed in FIG. 3. There is also, pre-printed box 50 in which may be printed "stamp here" or the like and which is located in the upper right corner or postage area of the envelope. Also shown is a plurality of lines and the printing "from" as indicated generally at 51 which may be used by the sender of the reply envelope for return address purposes.

When opening the two-way envelope 10, it is preferably grasped or pinched between the thumb and forefinger by the recipient at the left and right ends of the envelope, as viewed in FIG. 1, and the ends pulled or snapped in opposite directions to provide envelope portions 52 and 54 as seen in FIG. 4. Since there is no connecting adhesive 15 at the facing areas of the lines of perforations, the front panel portion 24 separates along line of perforations 20 from front panel portion 22, and back panel portion 30 substantially simultaneously separates from back panel portion 28 along line of perforations 26. In this way, envelope 10 separates along the lines of perforations 20 and 26 into the envelope portions 52 and 54. Envelope portion 52 includes interconnected front panel portion 22 and back panel portion 28, while envelope portion 54 includes interconnected front panel portion 24 and back panel portion 30. Envelope portion 52 provides a fully addressed reply envelope and envelope portion 54 is a discardable or waste portion. The insert 16 may then be removed from the envelope 10 (not shown in FIG. 4). The envelope portion 54 is shown having a bar code 55 which was printed by the postal service as the two-way envelope was passed through the OCR processing station.

The reply envelope 52 includes a pocket between the front panel portion 22 and back panel portion 28 for receiving an element (not shown) to be mailed or returned in the reply envelope. Reply envelope 52 includes an end closure flap 56 (FIG. 4) which is a right end portion of back panel portion 28 that extends rightwardly beyond the right edge of front panel portion 22. Instructions for using the reply envelope 52 may be printed on the inside of the flap 56 (FIG. 2). Flap 56 is formed because the lines of perforations 20 and 26 are laterally offset from each other with line of perforations 26 rightwardly of line of perforations 20. To sealingly close the reply envelope 52, the adhesive strip 32 is wetted and the closure flap 56 folded along the crease 47 and over front panel portion 22. Where desired, the adhesive strip 32 may be of the type which does not require wetting but is activated or exposed after a cover strip is removed from it. The closed reply envelope, as shown in FIG. 5, may then be provided with a stamp 58 and the reply envelope mailed. The reply envelope 52 will come within the type of mail sometimes referred to as "courtesy reply mail with pre-printed bar code." The original return address 42 is covered by flap 56 while the outgoing address 34, bar code 55 and canceled postage 40 are eliminated and not present on the reply envelope 52 since they are on the discardable envelope portion 54.

The preprinted identification or FIM code 48 and the portion 45 of the reply address are located on the outer side of back panel portion 28 (FIG. 3) relative to the tear line of perforations 26 and the right edge of front panel portion 22, such that when the end flap 56 of the reply envelope 52 (FIG. 4) is folded over front panel portion 22 to close the reply envelope, the FIM code 48 and bar 46 are located for postal service automated processing and the reply address 44–45 is completed by the addition of portion 45 to the portion 44 as seen in FIG. 5.

It is apparent that the reply address, postage, and markings such as FIM and bar codes, are so located or obscured on the originating two-way envelope 10 (FIG. 1) that they will not be reasonably mistaken by the mail processing equipment or personnel as applying to the originating two-way envelope. Also, the originating or outgoing address, postage, and any bar code, such as bar code 55, on the two-way envelope 10, are not present on the reply envelope 52 when it is mailed.

In FIGS. 6 and 7 there is illustrated a modified envelope 10' which differs from the embodiment of FIG. 1 only in the preprinting of the back panel and reply address portion on the front panel, and wherein like parts are indicated by like reference numerals but which are primed. In this case the reply address portion 44' on front panel 12' includes the city and state in addition to the numerical address code. The back panel 14' has printed thereon markings indicating that a "business reply" envelope, indicated generally at 60, will be provided and which generally includes printing indicating that it is first class mail, and with a permit number along with city and state and a statement that postage will be paid by the addressee (not shown). Also, an identification or FIM code indicated at 61 specifically for business reply mail and a box 62 with a statement that no postage is necessary, are included on back panel 14'. Heavy bars 64 adjacent the box provide an obvious indication that the envelope is of the "business reply" type. The front panel portion 22' has the pre-printed bar code 46' along with the reply address portion 44'.

Upon pulling or snapping the envelope portions of the two-way envelope 10' apart along lines of perforations 20' and 26', the business reply envelope 52' is formed by front and back portions 22' and 28' with a part of back panel portion 28' providing an end closure flap 56'. After wetting the adhesive on the flap 56' it is folded over front panel portion 22 to close the reply envelope. In FIG. 7 the business reply envelope, indicated at 52', is shown closed and ready for mailing.

A closed two-way envelope 70 in accordance with another embodiment of the present invention is shown in FIG. 8. Envelope 70 includes front and back panels 72 and 74, respectively, connected together by marginal adhesive 76 and is shown containing an insert 78. The front and back panel 72 and 74 have vertically extending breakable tear lines of perforations 80 and 82 (FIG. 9), respectively, extending between the upper and lower edges of the panels. The perforations are laterally offset from each other so as to provide an end flap 84 having a strip of adhesive 86 and which is part of back panel 74 when the envelope 70 is opened along the perforation lines 80 and 82, as indicated in FIG. 10. The marginal areas between the lines of perforations 80 and 82 are free of adhesive 76 to permit the envelope portions indicated at 88 and 90 in FIG. 10 to come apart during the opening of the envelope 70. The perforation line 80 divides the front panel into left and right panel portions 91 and 92 and the line of perforations 82 divides the back panel into left and right panel portions 93 and 94.

The outer side of the front panel (FIG. 8) has preprinted thereon an outgoing address 95 intersected by perforation line 80 and postage 97 for mailing the two-way mailer 70. To the left of the line of perforations 80 are a reply (and return) address 100, a corresponding bar code 102 and a related FIM code 104. With the postage in the upper right corner above outgoing address 95, the reply address will not be mistaken for the outgoing address.

When the envelope is opened by pinching the right and left ends and pulling or snapping them in opposite directions, the envelope portions 88 and 90 come apart along lines of perforations 80 and 86 so that the insert 78 can be removed.

The envelope portion 88 (FIG. 10) is a reply envelope which can receive a reply element or insert (not shown). The adhesive 86 can be wetted and the flap 84 folded over the front panel portion 91 to close the reply envelope. In doing so, the flap 84 covers those portions of the outgoing address 95, and bar code 96 (applied by the postal service) that are on the left portion 91 of the front panel so that they do not interfere with the mailing of the reply envelope. In this way, the outgoing address 95, postage 97 and the bar code 96 are essentially eliminated with respect to the reply envelope 88. The closed reply envelope 88 is shown in FIG. 11 with a postage stamp 105 and is ready for mailing.

Figure 12:
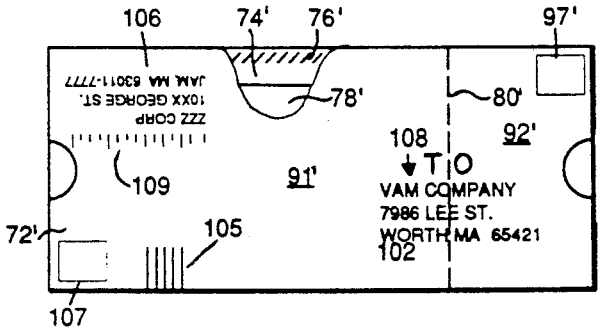
FIG. 12 is a plan view of the front side of a two-way envelope in accordance with another embodiment of the present invention.

FIG. 12 shows an envelope 70' identical to the envelope 70 of FIG. 8 except that the reply address, indicated at 106, and a corresponding bar code 109 are preprinted upside down relative to the outgoing address indicated at 108, and a FIM code 105 for the reply envelope portion is printed adjacent to the bottom edge of the front panel 72' of the envelope and spaced rightwardly of a postage indicating box 107 located in the left bottom corner of the two-way envelope. With the reply address 106 upside down (FIG. 12) it will not be mistaken for the outgoing address on the two-way envelope. Corresponding like elements are indicated by similar numerical designations but the designations are primed in FIG. 12.

Figure 13:
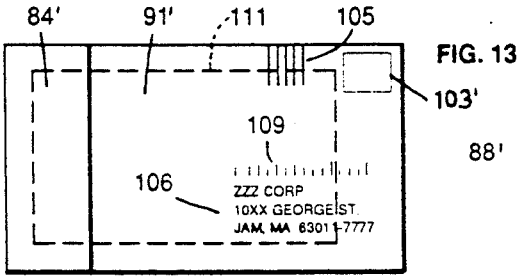
FIG. 13 is a plan view of a closed reply envelope portion formed after the envelope of FIG. 12 has been opened.

The envelope 70' is opened in the same manner as envelope 70 in FIG. 10 and the recipient can then remove the contents or insert 78'. The right hand envelope portion which includes front panel portion 92' and a right en portion of back panel 74' is discarded. After inserting an element 111 into the left envelope portion or reply envelope 88', the end flap 84', after wetting the adhesive thereon, is folded over the left portion 91' of front panel 72'. The reply envelope is then rotated 180 degrees about an axis normal to the front panel 72' and postage 103' is applied in the upper right hand corner of the reply envelope as seen in FIG. 13. The outgoing address 108, postage 97' and any bar code are essentially eliminated after the opening of the two-way envelope 70' and closing of the reply envelope 88'.

Figure 14:
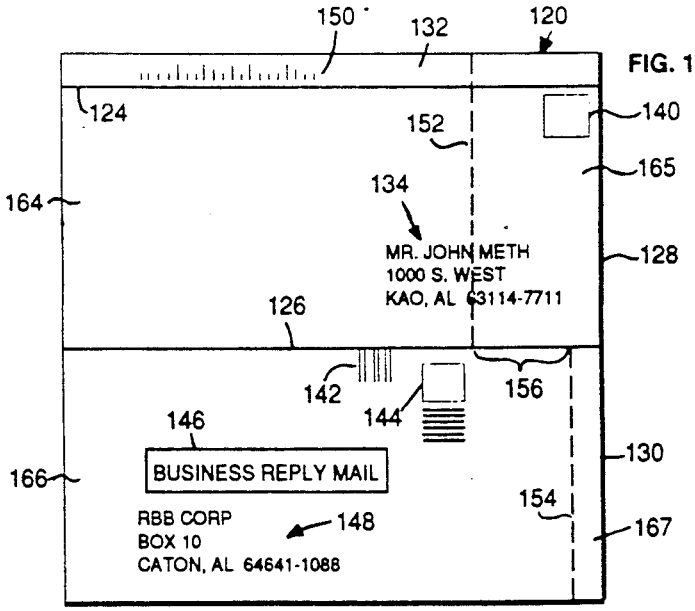
FIG. 14 is a plan view of the outer side of a sheet of paper adapted to form a two-way envelope in accordance with another embodiment of the present invention.
Figure 15:
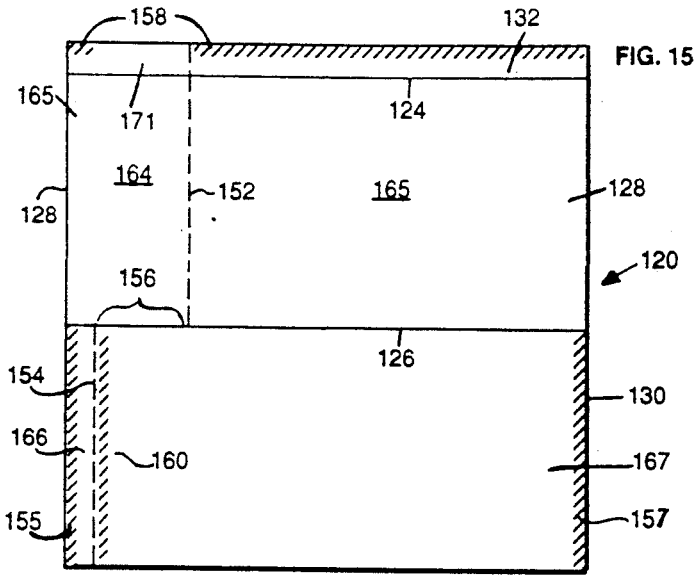
FIG. 15 shows the inner side of the sheet shown in FIG. 14.
Figure 16:
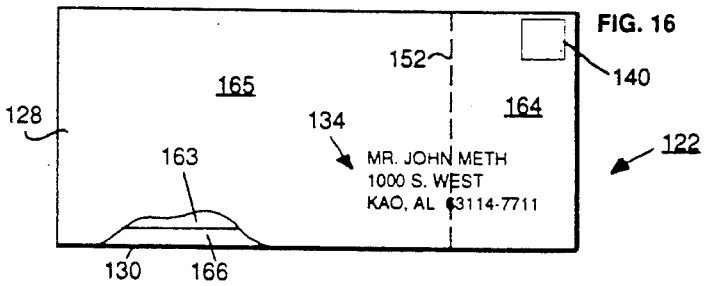
FIG. 16 is a plan view of the front side of the envelope formed of the sheet of FIG. 14.

In accordance with another embodiment, there is shown in FIGS. 14 and 15 a flat sheet of paper 120 adapted to form a reusable, two-way envelope 122 shown in FIG. 16. In FIG. 14 the side of sheet 120 shown is the side that becomes the outer sides of envelope 122 and the side shown in FIG. 15 is the opposite side of the sheet 120. Sheet 120 (FIG. 14) includes fold or crease lines 124 and 126 defining a front envelope panel 128, a back envelope panel 130, and a closure flap 132 when in the formed two-way envelope 122. Sheet 120 in FIG. 14 has printed on the front envelope panel 128 an outgoing address 134 for mailing the two-way envelope. Preprinted on the back envelope panel 130 is a FIM code 142 adjacent the fold line 126 and to the left of a box 144 containing the printing "No Postage Necessary if Mailed Within the U.S." (not shown). Also preprinted thereon is a notice 146 indicating that it is a business reply mailer and a reply address indicated at 148. A bar code 150 that corresponds to the reply address 148 is shown preprinted on the flap 132. A vertical line of perforations 152 on panel 128 extends vertically between the fold line 126 and the upper edge of flap 132. Another vertical line of perforations 154 extends between the bottom edge of the back panel 130 and the fold line 126. The line of perforations 152 and 154 are laterally offset from each other with a horizontal slit 156, coincident with the fold line 126, which extends between the lines of perforations 152 and 154, as Will be explained hereafter.

As seen in FIG. 15 the opposite side of sheet 120 is provided with lines of adhesive 155 and 157 along the margins a the opposite ends of back panel 130 and these lines of adhesive seal the front and back panels 128 and 130 together to form the two-way envelope 122 of FIG. 16. A strip of wettable adhesive 158 is shown disposed along the upper margin of flap 132, but a marginal area 171 of the flap between the lines of perforations 152 and 154 is free of this adhesive. The slit 156 and the adhesive free area 171 allow the two-way envelope to be opened. A line of wettable adhesive is indicated at 160 to the right of perforation line 154 of back panel 130 and extends vertically between the lower edge of panel 130 and the fold line 126 as viewed in FIG. 15. The line of perforations 152 divides the front panel 128 into left and right portions 164 and 165, respectively, and the line of perforations 154 divides the back panel into left and right portions 166 and 167, respectively. During manufacture, the sheet 120 is folded on fold line 126 so that the adhesive strips 155 and 157 seal the panels 128 and 130 together to form the two-way envelope 122. An insert 163, such as sheet of information can be inserted into the two-way envelope through the opening provided by flap 132. The adhesive 158 can be wetted and folded along fold line 24 over the back panel 130 to sealingly close the envelope 122 (FIG. 16).

Figure 17:
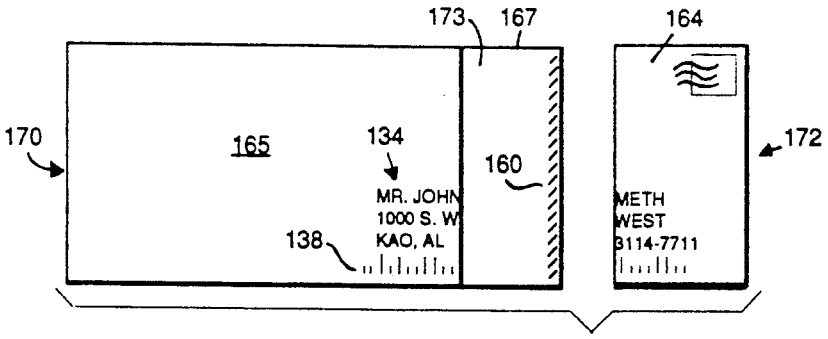
FIG. 17 is a plan view of the envelope of FIG. 16 after it has been opened.
Figure 19:
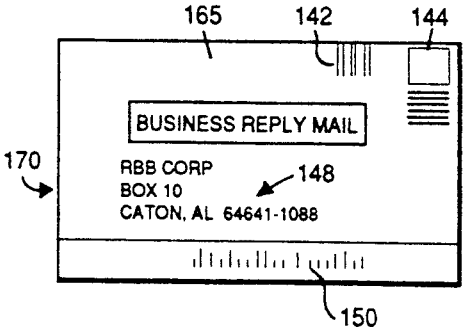
FIG. 19 is a plan view of the front side of the reply envelope formed by the left hand portion shown in FIG. 17 and after the reply envelope has been closed.
Figure 18:
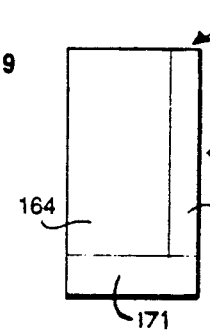
FIG. 18 is a plan view of the inner side of the right portion of the envelope shown in FIG. 17.

When the recipient receives the two-way envelope it may be readily opened by pinching the left and right end marginal areas and pulling or snapping the envelope apart as indicated in FIG. 17. The envelope separates along perforation lines 152 and 154 into two envelope portions 170 and 172. FIG. 18 shows the reverse side of envelope portion 172 of FIG. 17 and which includes the adhesive free portion 171 of closure flap 132 (FIG. 15). Envelope portion 170 provides a reply envelope having an end flap 173 formed by a part of back panel portion 167 that extends rightwardly of the right end of front panel portion 165 as a result of the laterally offset lines of perforations 152 and 54. After the outgoing insert 163 is removed and a reply insert inserted into the reply envelope 170, the adhesive 160 is wetted and the flap 173 folded over the front panel portion 165 to sealingly close the reply envelope. The outgoing address 134, bar code 138 applied by the postal service, and postage 140 will be completely, essentially eliminated from the reply envelope 170 since a portion of the outgoing address and the postage 140 are discarded with the discardable envelope portion 172 and the flap 173 covers the remaining portion of the outgoing address. When the reply envelope 170 is closed and turned to its opposite side it appears as shown in FIG. 19. The reply envelope has FIM 142, the reply address 148, the no-postage-needed reply indication 144, and the bar code 150 which was on the closure flap 132 of the original two-way envelope and which is now located below the reply address on the reply envelope. The business reply envelope 122 may now be mailed without the need of addressing or applying postage to it. The reply envelope being preprinted with address 148, FIM 142 and bar code 150 will be readily processed through the automated postal system. Since the postage and outgoing address are on the front panel when the two-way envelope 122 is mailed the reply address 148 will not be mistaken for the outgoing address of the two-way envelope.

Another modified embodiment is illustrated in FIGS. 20–23 where a two-way envelope 180 is shown including front and back panels 182 and 184. A line of perforations 186 is shown extending vertically between the upper and lower edges 187 and 189, respectively, of the front panel 182 dividing it into front panel portions 188 and 190. Front panel portion 190 has preprinted thereon an outgoing address 195, and a corresponding bar code 196. Postage 198 is in the upper right corner of the envelope. Only the left front panel portion 188 is fixedly connected to the back panel 184 and that is by adhesive indicated at 200 which extends adjacent three margins, that is, the bottom, left and top margins of the panel portion 188. The front panel portion 190 is removably connected to the back panel 184 along the top, right and bottom margins by easily broken dots of adhesive 202.

The back panel 184 is preprinted with a reply address 204, a bar code 206 corresponding to the reply address, a FIM code 208, and an indication 210 that no postage is required, as well as parallel bars 212, and an indication 214 that it is a business reply envelope. All of this is preprinted on a portion 215 of the back panel 184 which is to the right of the fold line 216 on panel 184 and the line of perforations 186 on front panel 182, as viewed in FIG. 21. Portion 215 of the back panel 184 becomes the closure flap for the reply envelope which is formed upon opening the two-way envelope 180. The two-way envelope 180 cannot be mismailed since the reply address 204, even if the two-way envelope is turned over, is not in a normal or usual position. With the envelope 180 pre-barcoded by the sender, it with generally other pre-barcoded envelopes can be taken to the postal service in order to avoid the necessity of bar code being applied by the postal service. Also, the postage 198 is above the outgoing address 195.

Figure 20:
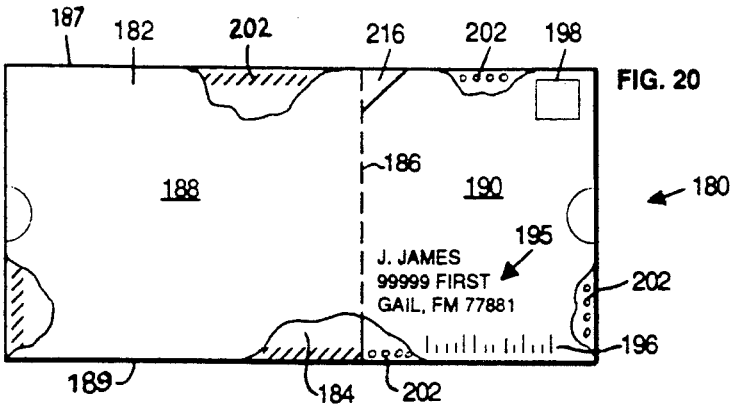
FIG. 20 is a plan view of the front side of a two-way envelope made in accordance with another embodiment of the present invention.
Figure 21:
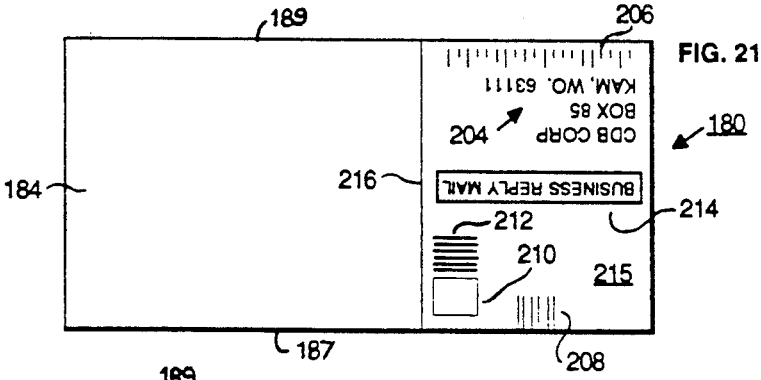
FIG. 21 is a plan view of the back side of the envelope of FIG. 20.
Figure 22:
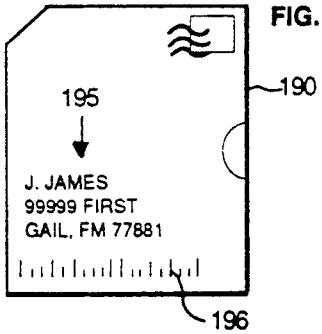
FIG. 22 is a plan view of a removed portion of the envelope of FIG. 20.

The recipient of the two-way envelope 180 in this case opens it by slipping an object such as a finger nail under the front panel portion 190 at a corner cut out indicated at 216 in FIG. 20 and pulling the front panel portion 190 downwardly and rightwardly in the direction of the arrow shown in FIG. 20. As this is done, the dots of adhesive 202 break as well as the line of perforations 186 thereby allowing removal of front panel portion 190 and removal of the contents or insert. The removed and discardable panel portion 190 containing the outgoing address 195 is shown in FIG. 22.

Figure 23:
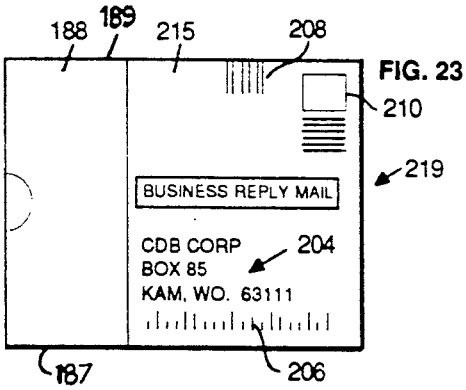
FIG. 23 is a plan view of a closed business reply envelope formed from the remaining portion of the two-way envelope of FIG. 20 after the two-way envelope has been opened.

The reply envelope indicated at 219 in FIG. 23 is formed by the entire back panel 184 and the left front panel portion 188. After a return insert is placed into the reply envelope 219 the portion 215 of the back panel 184 which serves as an end closure flap and may be folded over the front panel portion 188 to provide a fully addressed and preprinted reply envelope ready for mailing. Wettable adhesive (not shown) may be provided on the flap 215 to sealingly close the reply envelope.

Figure 24:
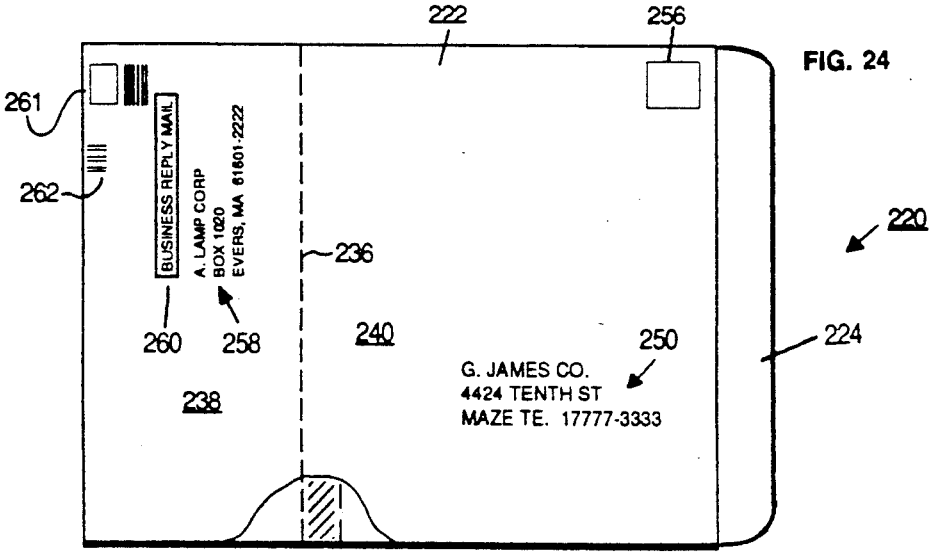
FIG. 24 is a plan view of the front side of a two-way envelope made in accordance with another embodiment of the present invention.
Figure 25:
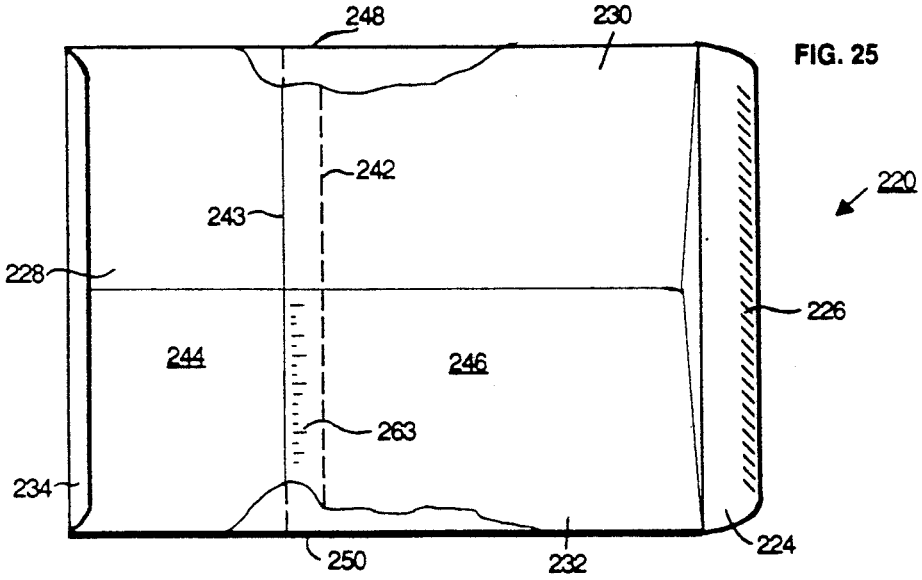
FIG. 25 is a plan view of the back side of the envelope of FIG. 24.

A two-way envelope 220 in accordance with another embodiment of the present invention is illustrated in FIGS. 24–27. Envelope 220 is of the size sometimes referred to as a "flat" and may be larger than a standard letter envelope. The envelope 220 includes a front panel 222 having a closure flap 224 integrally connected to the front panel and having a wettable adhesive 226 as seen in FIG. 25 for the purpose of sealingly closing the two-way envelope. Envelope 220 has a back panel 228 formed by upper and lower half panels 230 and 232 that are integrally connected to front panel 222 and adhesively connected at their overlapping ends at the center of the envelope. Front panel 222 also has an integral flap 234 at the left end which folds over the left end of the back panel 228 and it is adhesively connected to the two half panels to close the left end of the two-way envelope. Front panel 222 has a vertical line of perforations 236 extending from the bottom to the upper edges of the panel dividing it into a left front panel portion 238 and a right hand portion 240. Back panel 228 is also provided with a vertical line of perforations 242 which extends from the bottom to the top and which divides the back panel into left and right panel portions 244 and 246. Upper and lower slits 248 and 250 extend at the upper and lower edges of the envelope laterally between the front and back lines of perforations 236 and 242 to permit separation of the panels along these lines of perforations during the opening of the envelope 220. A fold line 243 on back panel 230 is substantially coincident with line of perforations 236 on front panel 222.

The exterior of front panel portion 240 has printed thereon an outgoing address 250 and postage indicated at 256. The left panel portion 238 has preprinted thereon a reply address 258, a business reply mail indicator 260, and a box 261 indicating that no postage is necessary, all extending vertically, that is, they are readable when the envelope is rotated 90 degrees about an axis normal to the plane of the front panel 222. The exterior of back panel 228, as seen in FIG. 25, has a reply bar code 263, extending vertically parallel to and between the line of perforations 242 and fold line 243 and disposed on back panel portion 244. After an insert to be mailed is placed in the two-way envelope 220, the adhesive 226 on the closure flap 224 is wetted and the flap folded over the back panel 228 to close the envelope. The envelope 220 may then be mailed.

Figure 26:
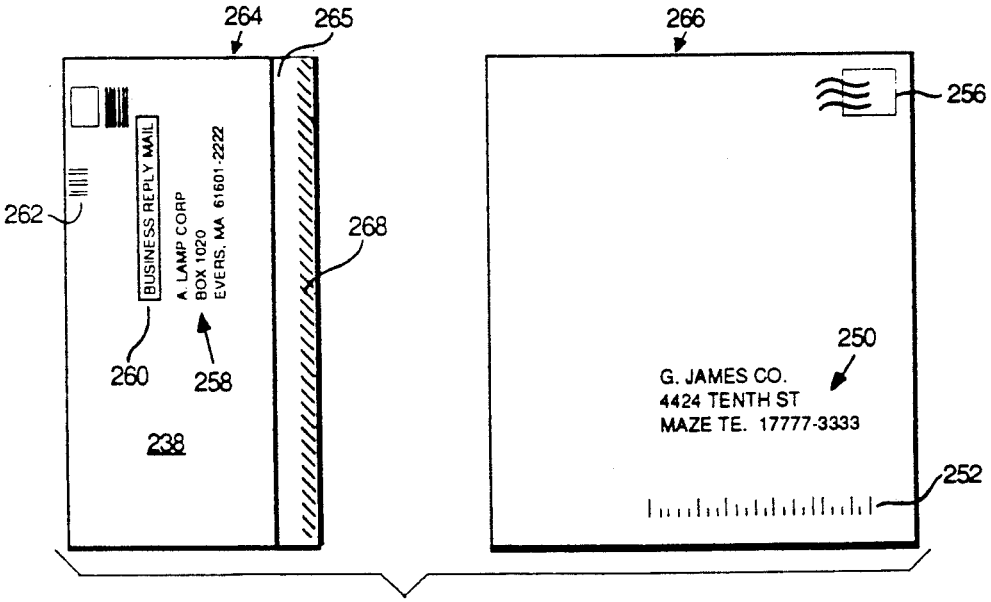
FIG. 26 is a plan view of the envelope of FIG. 24 after it is opened.
Figure 27:
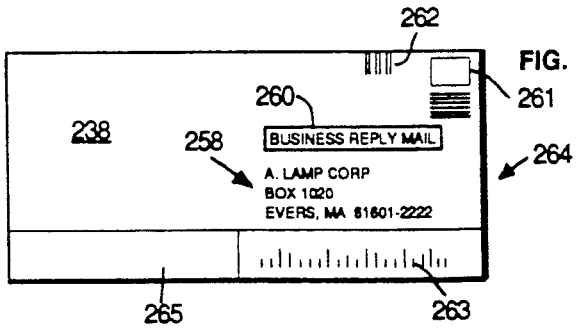
FIG. 27 is a plan view of the reply envelope formed by the left portion of the envelope shown in FIG. 26 after it is closed.
Figure 28:
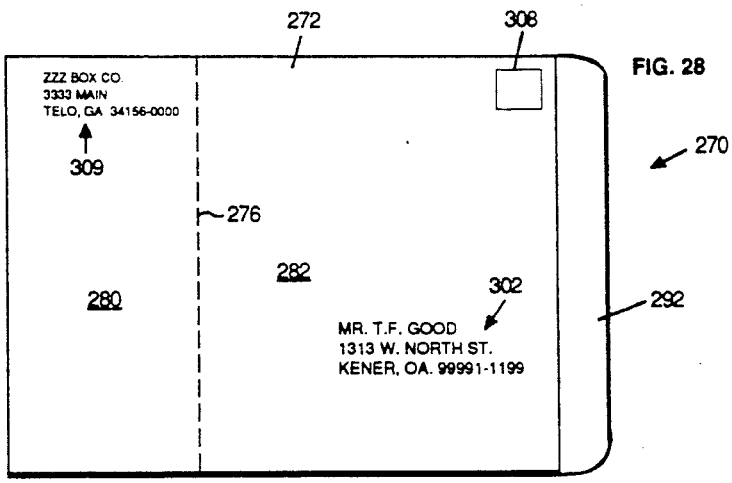
FIG. 28 is a plan view of the front side of a two-way envelope in accordance with another embodiment of the present invention.

Upon receiving the envelope 220, the recipient grasps both of the opposite ends of the envelope and pulls or snaps them in opposite directions to separate the envelope into two envelope portions 264 and 266 as seen in FIG. 26. Envelope portion 266 is discarded while the envelope portion 264 serves as a fully addressed business reply envelope. The slits 248 and 250 allow the lines of perforations 236 and 242 to break during opening. The original contents of envelope 220 are removed and a return insert or element is inserted into the pocket between the front and back panel portions 238 and 244 of reply envelope 264. Portion 244 extends rightwardly beyond the front panel portion 238 to form an end closure flap 265 having an adhesive 268 thereon. The flap 265 is folded over the front panel portion 238 after the adhesive 268 is wetted to sealingly close the reply envelope 264. The bar code 263, as seen in FIG. 27, is now disposed just below the reply address 258 on the closed reply envelope since it is on the outer side of flap 265 (FIG. 25). The business reply envelope 264 as seen in FIG. 27 is closed and ready for mailing. It should be noted that the reply address 258 on the front panel 222 of the two-way envelope as seen in FIG. 24 cannot reasonably be mistaken for the outgoing address since it is normal to the outgoing address with postage 25 and extends parallel to the shorter dimension of the two-way envelope. Also, the outgoing address 250 is not present on the reply envelope (FIG. 27) since it is on the discardable envelope portion 266.

A two-way envelope 270 in accordance with another embodiment of the present invention is illustrated in FIGS. 28–31. Envelope 270, which is somewhat similar in construction to envelope 220 of FIG. 24, includes front and back panels 272 and 274 and laterally offset vertical lines of perforations 276 and 278, respectively. Line of perforations 276 which extends between the upper and lower ends of the envelope divides the front panel 272 into left and right envelope portions 280 and 282, and the line of perforations 278 which also extends between the upper and lower ends of the envelope divides back panel 274 into left and right panel portions 284 and 286. The back panel includes two half panels 288 and 290 adhesively connected together at the center of the envelope and which are integrally connected to front panel 282 at the upper and lower edges, respectively. The front panel 272 has a closure flap 292 integrally connected to the right side thereof which has a strip of adhesive 294 and a flap 296 at the left side which is adhesively connected to the back half panels 288 and 290.

Figure 29:
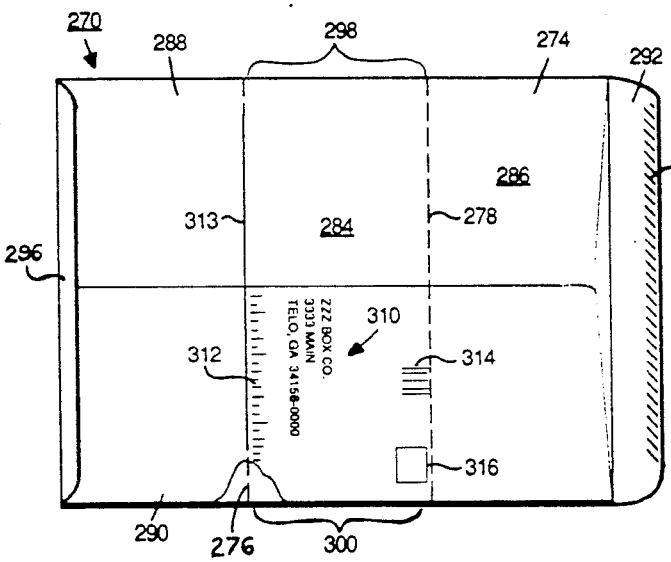
FIG. 29 is a plan view of the back side of the envelope of FIG. 28.

As seen in FIG. 29, slits indicated at 298 and 300 extend between the lines of perforations 276 and 27 at the top and bottom edges of the envelope thereby separating the back and front panels 272 and 274 from each other between the lines of perforations 276 and 278. The exterior side of front panel 272 (FIG. 28) includes an outgoing address 302, postage indicated at 308 and a return address 309.

The back panel includes a reply address 310, a corresponding bar code 312, a FIM 314 and a box 316 indicating the area to which a postage stamp is to be applied, all of this printed matter extending vertically or normal to the longitudinal or longer axis of the two-way envelope, that is, so that it may be read when the envelope 270 is rotated from its position in FIG. 29 about an axis normal to the plane of the envelope. After an insert to be mailed is inserted into the envelope 202 the adhesive 294 is wetted and the flap 292 folded over the back panel 274 to close the two-way envelope making it ready for mailing.

Figure 31:
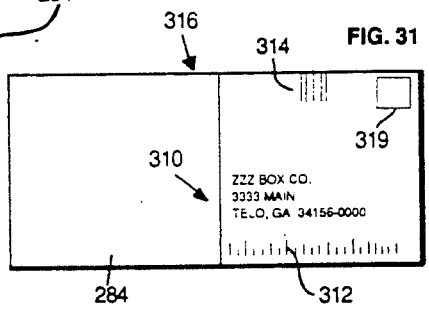
FIG. 31 is a plan view of the reply envelope formed by the left hand portion of the envelope shown in FIG. 30 after it is closed.
Figure 30:
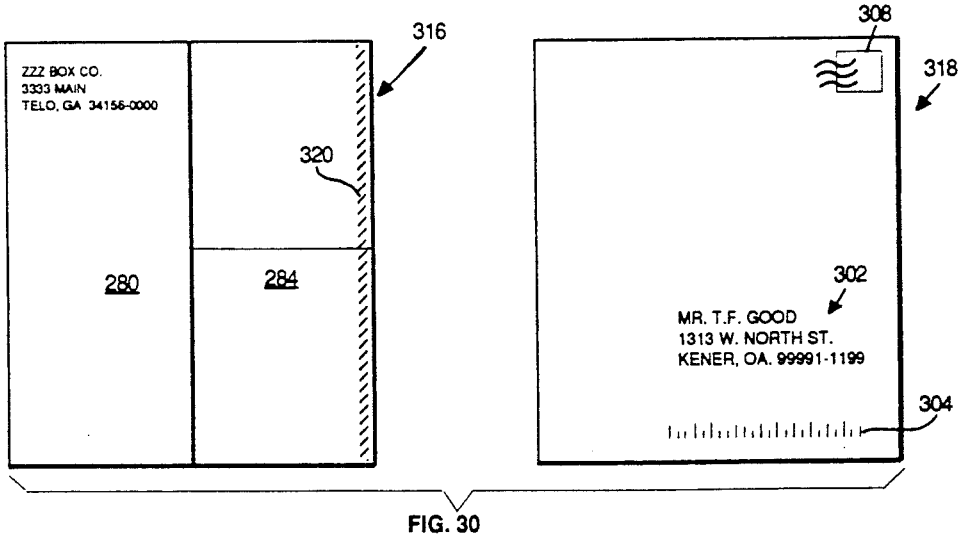
FIG. 30 is a plan view of the envelope of FIG. 28 after it has been mailed and opened.

When the recipient receives the two-way envelope 270 in the mail the opposed ends of the envelope can be pinched and the envelope pulled in opposite directions to snap open the envelope and remove the contents (not shown). Because of slits 298 and 300, the envelope divides on the lines of perforations 276 and 278 to form two envelope portions 316 and 318, as seen in FIG. 30. Envelope portion 318 is discarded and portion 316 provides a preprinted reply envelope to which a return element may be inserted. Adhesive 320 (FIG. 30) is provided o the back panel portion 284 that extends rightwardly of the front panel portion 280 and which serves as an end closure flap. The end closure flap 284 may be folded over portion 280 after wetting adhesive 320 to seal the reply envelope closed. The reply address 310, that was originally on the back side of the two-way envelope 270, now appears on the reply envelope 316 which, after postage 319 is applied, is ready for mailing as seen in FIG. 31.

The reply address 310 extends vertically on the back side of the two-way envelope 270 as seen in FIG. 29 so that it cannot be mistaken for the outgoing address of the two-way mailer. Also, the outgoing address 302 is discarded and does not appear on the reply envelope (FIG. 31) so that the reply envelope cannot be mismailed.

Figure 32:
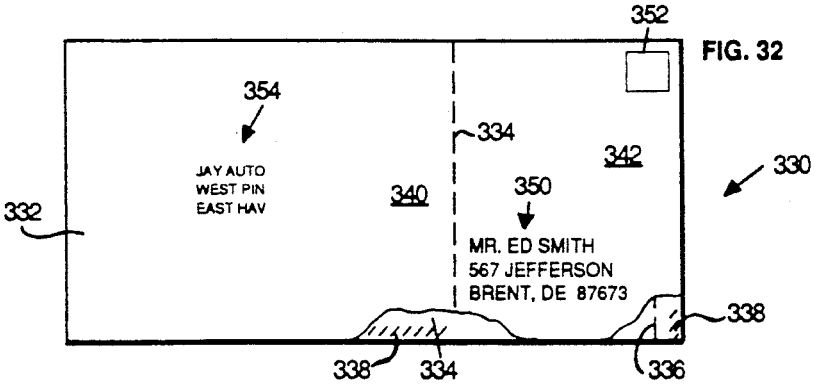
FIG. 32 is a plan view of a two-way envelope in accordance with still another embodiment of the present invention.
Figure 33:
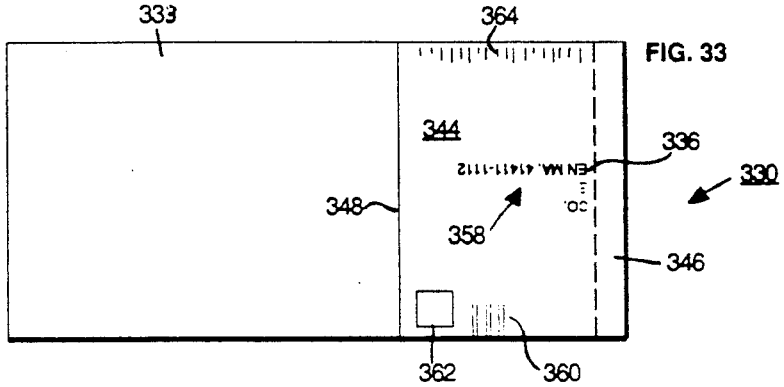
FIG. 33 is a plan view of the back side of the envelope of FIG. 32.

There is illustrated in FIGS. 32–35 still another embodiment of the present invention. A two-way envelope 330 is shown in FIG. 32 including front and back panels 332 and 333. Laterally offset lines of perforations 334 and 336 on panels 332 and 333 extend vertically between the lower and upper edges of the panels. The panels are connected together by adhesive strips 338 at the margins of the panels except that facing marginal areas of the panels between the lines of perforations are free of the adhesive 338. The line of perforation 334 divides the front panel 322 into left and right panel sections 340 and 342, and the line of perforations 336 divides the back panel 333, as best seen in FIG. 33, into back panel sections 344 and 346. A vertical fold line 348 on back panel 334 is substantially coextensive with the front line of perforations 334.

An outgoing address 350 and postage 352 are shown on the right section 342 of the front panel and a preprinted left portion of a reply address 354 is shown on left portion 340 and which extends longitudinally of the envelope as does the outgoing address 350.

The other portion of the reply address, indicated at 358, is predeterminately preprinted on the back panel portion 344, in an upside down manner as viewed in FIG. 33, adjacent the line of perforations 336 and in an area between this line of perforations and the fold line 348. Also, preprinted in this area are a FIM mark 360 at the bottom edge, a postage notice box to the left of the FIM mark 362, and a reply address bar code 364 printed upside down adjacent the upper edge of the back panel as viewed in FIG. 33.

Figure 34:
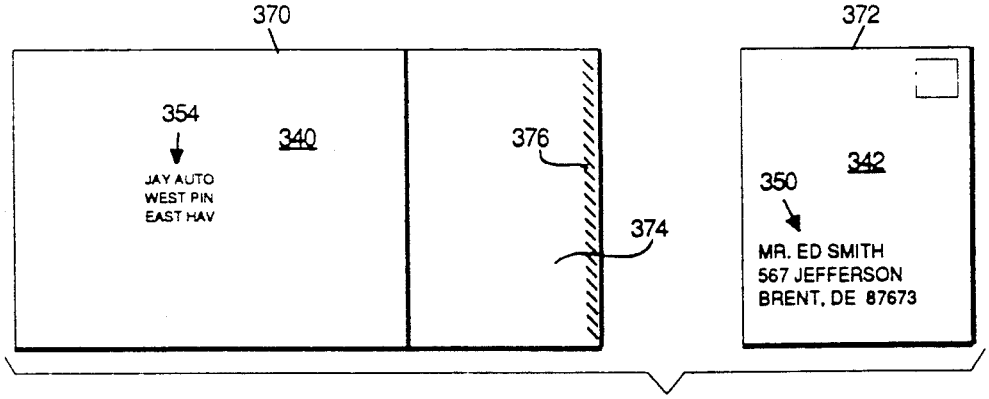
FIG. 34 is a plan view of the envelope of FIG. 32 after it has been opened.

When the two-way envelope 330 is opened by pulling or snapping the right and left end portions of the envelope apart as viewed in FIG. 32, the left panel sections 340 and 344 separate along the lines of perforations 334 and 348 from the right panel sections 342 and 346 to provide left and right envelope portions 370 and 372 as seen in FIG. 34. The envelope portion 372 having the outgoing address 350 thereon and which includes panel sections 342 and 346 is discarded. The envelope portion 370 provides a reply envelope having an end closure flap indicated at 374 and which is a portion of back panel portion 344 that extends rightwardly beyond the right edge of front panel section 340. The right marginal area of the flap is provided with wettable adhesive 376.

Figure 35:
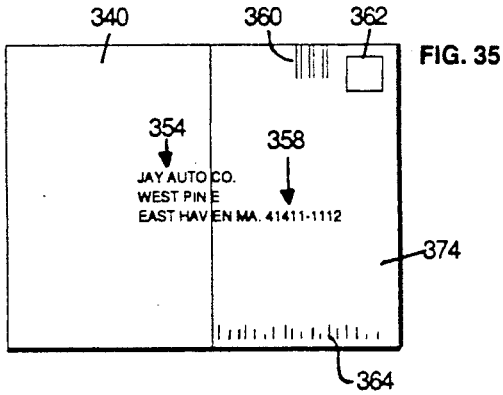
FIG. 35 is a plan view of the closed reply envelope formed by the left hand portion of the envelope shown in FIG. 34.

After an element is inserted into the reply envelope, the adhesive 376 is wetted and the flap 374 folded along fold line 348 and over the front panel portion 340 as shown in FIG. 35. It is seen that the reply address portion 358 is located to join the reply address portion 354 to thereby complete the reply address 354–358. Also, the FIM mark 360 and bar code 364 as well as the postage box 362 are located for mailing the reply envelope 370.

It is apparent that the outgoing two-way envelope 330 (FIG. 32) cannot be inadvertently mailed to the reply address since only a portion thereof appears on the face of the two-way envelope. Furthermore, even if the back side of the two-way envelope (FIG. 33) is first seen by a postal service employee, only a portion 358 of the reply address is seen so that the reply address cannot be mistaken for the outgoing address.

It will now be apparent that a two-way envelope according to the present invention can be made which has but two panels so that there are savings in the amount of paper required by the two-way envelope, reduced waste material, reduced tree cutting for paper stock, and reduced mailing weight and bulk compared to the conventional use of two separate envelopes.

As described herein, in the embodiments of FIGS. 1, 8 and 32, a portion of the reply address is located on the left section of the front panel and another portion on the back panel portion that forms the end closure flap. When the reply envelope is closed by the flap, the entire reply address is on the face of the reply envelope. If desired, the entire reply address, as well as the bar code and FIM code for the reply envelope can be placed on the end closure flap in these embodiments.

It is to be understood that the foregoing description and drawings have been given by way example and that changes that are apparent to one skilled in the art are contemplated as within the scope of the invention which is limited only by the claims which follow.

What is claimed is:

1. A two-way envelope comprising front and back panels connected together to form a pocket therebetween for containing an element to be mailed, said front panel having an outgoing address area for receiving an original outgoing mailing address, a first line of perforations on said front panel extending between the upper and lower edges thereof dividing said front panel into left and right sections between the left and right end edges of the two-way envelope, a second line of perforations on said back panel extending between the upper and lower edges thereof and laterally offset rightwardly of said first line of perforations dividing said back panel into left and right sections between the left and right end edges of the two-way envelope, said right sections separating from said left sections along said first and second lines of perforations in response to forces tending to pull the left and right sections apart during the opening of the two-way envelope to provide a discardable envelope portion including said right sections, and a reply envelope including said left sections, a part of said left section of said back panel extending rightwardly beyond said left section of said front panel to provide a right end closure flap foldable over said left section of said front panel for closing said reply envelope, the two-way envelope having a reply address, a reply bar code corresponding to said reply address and readable by a postal service code reader for sorting mail and, an identification code indicating the presence of said reply bare code and readable by a postal service code reader, at least a portion of said reply address and said indentification code being located on said part of said left section of said back panel of the two-way envelope and extending parallel to said end edges, said reply bar code being on said left section of said front panel and extending parallel with and adjacent to the left end edge of the two-way envelope, said second line of perforations being laterally offset rightwardly from said first line of perforations such that after the two-way envelope is opened and said end closure flap is folded over said left section of said front panel said reply envelope includes said reply address, said reply bar code, and said indentification code but is essentially free of said outgoing mailing address area.

2. The two-way envelope of claim 1 further including an original outgoing address in said outgoing address area extending substantially parallel with said upper and lower edges.

* * * * *